US012698128B2

(12) United States Patent
Morris

(10) Patent No.: US 12,698,128 B2
(45) Date of Patent: Aug. 4, 2026

(54) CONTAINER APPARATUS AND METHODS OF FORMING THE SAME

(71) Applicant: Nathan Morris, Durango, CO (US)

(72) Inventor: Nathan Morris, Durango, CO (US)

(73) Assignee: Nathan Morris, Durango, CO (US)

( * ) Notice: Subject to any disclaimer, the term of this patent is extended or adjusted under 35 U.S.C. 154(b) by 128 days.

(21) Appl. No.: 18/902,358

(22) Filed: Sep. 30, 2024

(65) Prior Publication Data

US 2025/0128856 A1 Apr. 24, 2025

Related U.S. Application Data

(60) Provisional application No. 63/541,789, filed on Sep. 30, 2023.

(51) Int. Cl.

| | |
|---|---|
| ***B65D 21/02*** | (2006.01) |
| ***B65D 1/26*** | (2006.01) |
| ***B65D 25/28*** | (2006.01) |
| ***B65D 25/56*** | (2006.01) |

(52) U.S. Cl.

CPC ..... *B65D 21/0233* (2013.01); *B65D 1/265* (2013.01); *B65D 25/2897* (2013.01); *B65D 25/56* (2013.01)

(58) Field of Classification Search

CPC .... B65D 21/0233; B65D 21/02; B65D 1/265; B65D 25/2897; B65D 25/56

USPC ..... 206/514, 515, 519, 520

See application file for complete search history.

(56) References Cited

U.S. PATENT DOCUMENTS

| | | | |
|---|---|---|---|
| 645,430 | A | 3/1900 | Smelker |
| 727,808 | A | 5/1903 | Knowlton |
| 1,075,119 | A | 10/1913 | Reicher |
| 2,982,440 | A | 5/1961 | Harrison |
| 3,094,240 | A | 6/1963 | Wanderer |
| 3,139,213 | A | 6/1964 | Bryant |
| 3,347,411 | A | 10/1967 | Kalata |
| 3,587,944 | A | 6/1971 | Pehr |
| 3,620,437 | A | 11/1971 | Kulp |
| 3,739,939 | A | 6/1973 | Koenig |
| 3,840,143 | A | 10/1974 | Davis |
| 4,125,218 | A | 11/1978 | Deboer |
| 5,573,118 | A | 11/1996 | Cramer |

(Continued)

FOREIGN PATENT DOCUMENTS

| | | |
|---|---|---|
| EP | 0183326 | 6/1986 |
| EP | 2084073 | 8/2009 |

(Continued)

OTHER PUBLICATIONS

Amazon, Inc., https://www.amazon.com/Storage-Stackable-Interlocking-Containers-Findings/dp/B001AS6OLK, Oct. 28, 2014.

*Primary Examiner* — Jacob K Ackun

(74) *Attorney, Agent, or Firm* — McCarter & English, LLP; Charles A. Rattner

(57) ABSTRACT

Improved containers nest inside of each other when empty, thereby saving storage and transport space. Smaller containers can nest inside of larger containers for increased space efficiency. These containers, in various instances, use standard-sized canning jar lids, such as 'small-mouth' or 'large-mouth' jars and the like, to prevent "orphaning" of containers and lids.

20 Claims, 18 Drawing Sheets

(56) References Cited

U.S. PATENT DOCUMENTS

| | | | | |
|---|---|---|---|---|
| 6,065,603 | A * | 5/2000 | Filice | A47G 19/23 206/217 |
| 6,983,859 | B2 | 1/2006 | Azzarello | |
| 7,097,058 | B2 | 8/2006 | Wellman | |
| 7,270,959 | B2 | 9/2007 | Hudak | |
| 7,546,932 | B2 | 6/2009 | Smith | |
| 7,726,483 | B2 | 6/2010 | Ramanujam | |
| 9,242,771 | B2 | 1/2016 | Steig | |
| 9,663,269 | B1 | 5/2017 | Lasris | |
| 2002/0172818 | A1 | 11/2002 | Debraal | |
| 2014/0144804 | A1 * | 5/2014 | Roodnat | B65D 21/0233 206/511 |
| 2015/0360832 | A1 | 12/2015 | Washelski | |
| 2022/0134405 | A1 * | 5/2022 | Whitmore | B21D 51/2646 206/519 |
| 2024/0116665 | A1 * | 4/2024 | Lehner | B65D 1/42 |
| 2025/0313371 | A1 * | 10/2025 | Holstine | B65D 1/265 |
| 2025/0326518 | A1 * | 10/2025 | Earl-Torniainen | B65D 1/40 |

FOREIGN PATENT DOCUMENTS

| | | |
|---|---|---|
| EP | 2778089 | 9/2014 |
| EP | 2840939 | 3/2015 |
| WO | WO2003070582 | 8/2003 |
| WO | WO2017051311 | 3/2017 |

* cited by examiner

10

```
FUNCTION compute
   SET volume TO config["volume"]

   IF config["volume_unit"] IS "oz" THEN
      SET volume TO volume * JAR_CALC_OZ_TO_MM3
   ELSE IF config["volume_unit"] IS "ml" THEN
      SET volume TO volume * JAR_CALC_ML_TO_MM3
   END IF


   SET extra_percent TO config["volume_extra_percent"]
   IF extra_percent > 0 THEN
      SET volume TO volume * (100 + extra_percent) / 100.0
   END IF


   SET r_mouth TO (config["mouth_size"] - 2 * config["thickness"]) / 2.0
   SET r_base TO r_mouth - 3 * config["thickness"]

   INITIALIZE solutions AS an empty list

   FOR i FROM 0 TO config["max_solutions"] - 1
      SET height TO 3 * volume / (PI * (r_mouth * r_mouth + r_base *
r_base + r_base * r_mouth))
      SET wall_angle TO atan((r_mouth - r_base) / height) * 180 / PI
      SET wall_angle_rad TO wall_angle * PI / 180
      SET mouth_thickness TO config["thickness"] / cos(wall_angle_rad)
      SET inner_triangle_area TO height * tan(wall_angle_rad) -
(config["thickness"] / cos(wall_angle_rad))
      SET outer_triangle_area TO height * tan(wall_angle_rad)
      SET triangle_ratio TO (height * tan(wall_angle_rad) -
(config["thickness"] / cos(wall_angle_rad))) / (height * tan(wall_angle_rad))

      CREATE solution AS a dictionary with the
following keys and values:
         "od_mouth" : config["mouth_size"]
         "r_mouth" : r_mouth
         "d_mouth" : 2 * r_mouth
         "od_base" : 2 * r_base + 2 *
config["thickness"]
         "r_base" : r_base
         "d_base" : 2 * r_base
         "height" : height
         "w_angle" : wall_angle
         "inner_triangle_area" : inner_triangle_area
         "outer_triangle_area" : outer_triangle_area
         "triangle_ratio" : triangle_ratio
         "mw_ratio" : mouth_thickness / wall_angle


      ADD solution TO solutions
      SET r_base TO r_base - config["step"]
      IF r_base < config["min_base_radius"] THEN
         BREAK the loop
      END IF
   END FOR


   RETURN solutions
END FUNCTION
```

FIG. 18

CONTAINER APPARATUS AND METHODS OF FORMING THE SAME

CROSS-REFERENCE TO RELATED APPLICATIONS

This application claims priority under 35 U.S.C. § 119 to U.S. Provisional Patent Application Ser. No. 63/541,789 entitled "CONTAINER APPARATUS AND METHODS OF FORMING THE SAME" filed in the name of Nathan Morris on Sep. 30, 2023, the entirety of which is hereby incorporated by reference.

TECHNICAL FIELD

This disclosure generally relates to containers, and in particular, it relates to jars and the like with a non-uniform cross-section or periphery along its central axis, such as but not limited to a conical cross-section.

BACKGROUND OF THE DISCLOSURE

Existing canning jars are space-inefficient when they're empty, which is most of their usable life. Because canning jars are space-inefficient when empty, there's no compelling reason to manufacture and sell the same style of jars manufactured with differing materials. Because existing jars are space-inefficient when empty, and because the jars aren't manufactured using different materials, current canning jars cannot form a comprehensive storage system. Current canning jars typically do not have a pour spout. Existing food storage systems other than canning jar systems usually do not have measurement marks, and those systems like canning jars, that do have measurement marks, tend to only be in larger delineations, such as ounces and cups. Current canning jar systems also do not generally have any features to improve grip. Various existing canning jars are designed to make a seal under vacuum, but do not seal when internal pressure exceeds atmospheric or external pressure. Certain prior nesting containers can form a vacuum seal when nested together, even when moisture is present between the containers, however, prior nesting containers often have an unsteady or imperfect fit or seat when nested together.

Furthermore, existing food packaging jars and containers tend to be one-off, proprietary containers that eventually end up at the recycling center or the landfill. The lids for various prior containers are typically proprietary and divergent in size and configurations, such that they almost never fit any other brand of containers, and there are very few functional uses for such jars and lids once the original contents are consumed. Additionally, as prior jar and container systems are being shipped from the jar manufacturer to the food packager in the supply chain, they are very space-inefficient regarding transport as well as related increases in shipping costs. Accordingly, there is a need for an improved container system that addresses and overcomes such deficiencies.

SUMMARY OF THE DISCLOSURE

The disclosed container system solves the problem of inefficient space usage caused by conventional canning jars, storage containers and the like, resulting in, for example, overcrowded, cluttered cabinets, drawers, pantries, as well as other locations in residences, commercial or transport locations. Additionally, the disclosed container system uses a standardized set of lids that allows one set of lids to fit many differing volume capacities of storage containers. The disclosed container system thereby averts the conventional problem of accumulation of orphaned and mismatched lids or containers that typically results over time using conventional storage containers from differing manufacturers.

Certain of the disclosed containers have an internal pour spout to aid in pouring liquids from the containers. The improved containers can be manufactured and sold in a variety of volumes and sizes. The containers can be manufactured in many types of materials, and yet still function together as a storage system. The containers are mathematically calculated to nest together in the most efficient way possible for each size, prioritizing both stability and space efficiency. The containers have an engineered cavity in the threads that keeps the lid sealed tightly against internal pressure. The containers have special protrusions that aid in gripping the containers, as well as providing a natural balance point when pouring.

BRIEF DESCRIPTION OF THE DRAWINGS

Further aspects of the present disclosure will be more readily appreciated upon review of the detailed description of its various embodiments, described below, when taken in conjunction with the accompanying drawings, of which:

FIG. 18 is exemplary programming code for determining the sizes of suitable containers during a manufacturing process and the like.

DETAILED DESCRIPTION OF THE SPECIFIC EMBODIMENTS

Figure 1:
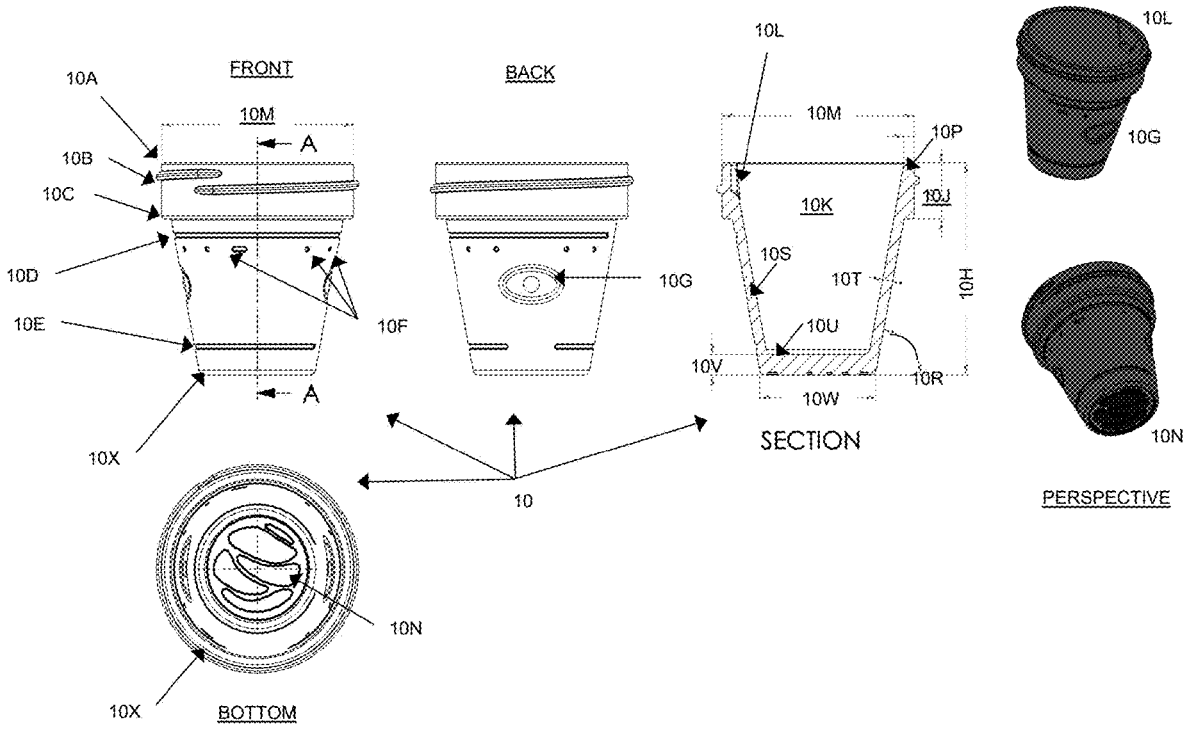
FIGS. 1-6 are schematic diagrams of the disclosed container system in accordance with various embodiments.

The improved jar/container systems introduced herein have various applications in the home, as well as medical, manufacturing, hobby, brewing, food packaging, food shipping, canning and other relevant industries. The disclosed container systems, in various embodiments, include two or more containers that are configured to nest inside of each other when empty. In certain cases, the containers are sized for compatibility with existing, standardized canning jar lids such as BALL, KERR, and other like manufacturers. When empty, the disclosed containers nest inside of each other in a similar manner to pint glasses or dixie cups, which translates to 50% or more space savings when not in use for food or liquid storage. In some embodiments, the disclosed container system is a system of individually nestable canning and storage jars, however all contemplated embodiments herein are not so limited and may include other similar containers. The containers of the disclosed container system, in differing embodiments, are composed of one or more of glass, plastic, polymer, metal, ceramics, rubber, stone, or other waterproof and durable materials or combinations of the same. In some embodiments described and shown herein, the disclosed containers are entirely made of glass, so as to be fully functional as conventional canning jars. In some embodiments, the containers are formed from a molding process. In some embodiments, the containers and lids are one or more of: transparent, translucent, opaque and/or have any one or more of a variety of colors, visual patterns, images, text, and the like, on the various surfaces thereof.

In various embodiments, the disclosed containers are provided in any of a wide variety of sizes. In the present disclosure, containers that hold a volume of 16 ounces (oz), 6 oz and 4 oz are referenced in various instances by way of example only. However, the disclosure and relevant embodiments described herein are not so limited. In various instances, the disclosed containers are necessarily tapered from top to bottom to facilitate nesting, thereby having a non-uniform circumference along the length of its central axis. In certain embodiments where the container is composed of glass, the wall thickness of the container is selected to withstand the rigors of the canning process. In various such cases, the angle of the taper of the exterior wall thereof is also specified to balance the wall thickness with the nesting aspect of the jars.

In various embodiments, the improved containers have a pour spout disposed on the inner wall at a top portion of the container for easier pouring or sipping, and finger grips of various configurations disposed and/or provided on the exterior wall thereof for easier grasping by a user. In various embodiments, the pour spout, with its particularly disclosed location within the inner wall extending toward the top of a container, doubles as an air gap to prevent the nested containers from adhering together due to moisture cohesion or suction, as experienced with various prior nesting containers. In various instances, the exterior walls of the disclosed containers additionally have internally- or externally-disposed measurement marks for more productive cooking uses. In some cases, the measurement marks contain indented or raised tic marks (configured such as, but not limited to dashes, dots, or a combination thereof) that are spaced apart and have visible numerical indication for volume measured in teaspoons, tablespoons, milliliters, ounces, ½ cups, cups and other useful English or metric units.

The improved container system introduced herein is designed to replace primarily four types of existing products: (1) canning jars like BALL, KERR, MASON etc., as typically used by home-based canners; (2) small storage containers (volume capacity of 4 oz-8 oz) for home kitchens and school lunches like those sold in retail stores by TUPPERWARE, GLAD, and the like, whose container products are primarily composed of plastic; (3) food packaging jars like those found in grocery stores for pickles, jams and the like (that are typically made from glass); and (4) reusable containers for coffee, water, and the like, either insulated and non-insulated. The disclosed container system significantly improves each of the above.

With respect to (1) above, existing canning jars are very space in-efficient when empty. Additionally, most canning jars are either used for canning or drinking. The disclosed container system is designed to also be used for everyday food storage like school lunches and leftovers, in addition to being fully functional canning jars. Moreover, because various embodiments of the disclosed container system use standard canning lids, they take advantage and are compatible/interchangeable with the existing market ecosystem and popularity of existing canning jar products. Lastly, the disclosed container system has several features that existing canning jars do not, namely, a pour spout, finger grips, and additional measurement markings.

With respect to (2)-(4) above, existing storage container systems for school lunches, leftover food storage or the like in the 4-16 oz range typically degrade as containers or lids are lost, resulting in orphaned lids or containers over time. Accordingly, the typical owner of conventional containers is left with extra lids that don't fit other containers, or conversely, extra containers with no fitted lids. Many proprietary manufacturers will either discontinue certain types of containers or change the design over time as well, so that it becomes difficult to find new lids for old containers.

The improved container system solves this and other problems by taking advantage of the existing value created by standardized and long-used canning jar lid sizes. The disclosed improved container system, in various cases, will fit the standard ever-present lids our grandparents used, which are the lids our grandchildren will likely continue to use. Additionally, the disclosed container system will be made of almost any material, so the lids for the glass jars will also cross-fit with the standard-sized lids of various materials, while remaining nestable and stackable with other like improved containers. Use of the disclosed container system by jar and food manufacturers would save considerable shipping and storage costs, as the disclosed container system, when empty, is at least 50% more space efficient than standard jars in volume sizes of 4-16 oz and higher, with increasing space efficiency resulting as more containers and greater volumes are used.

Figure 2:
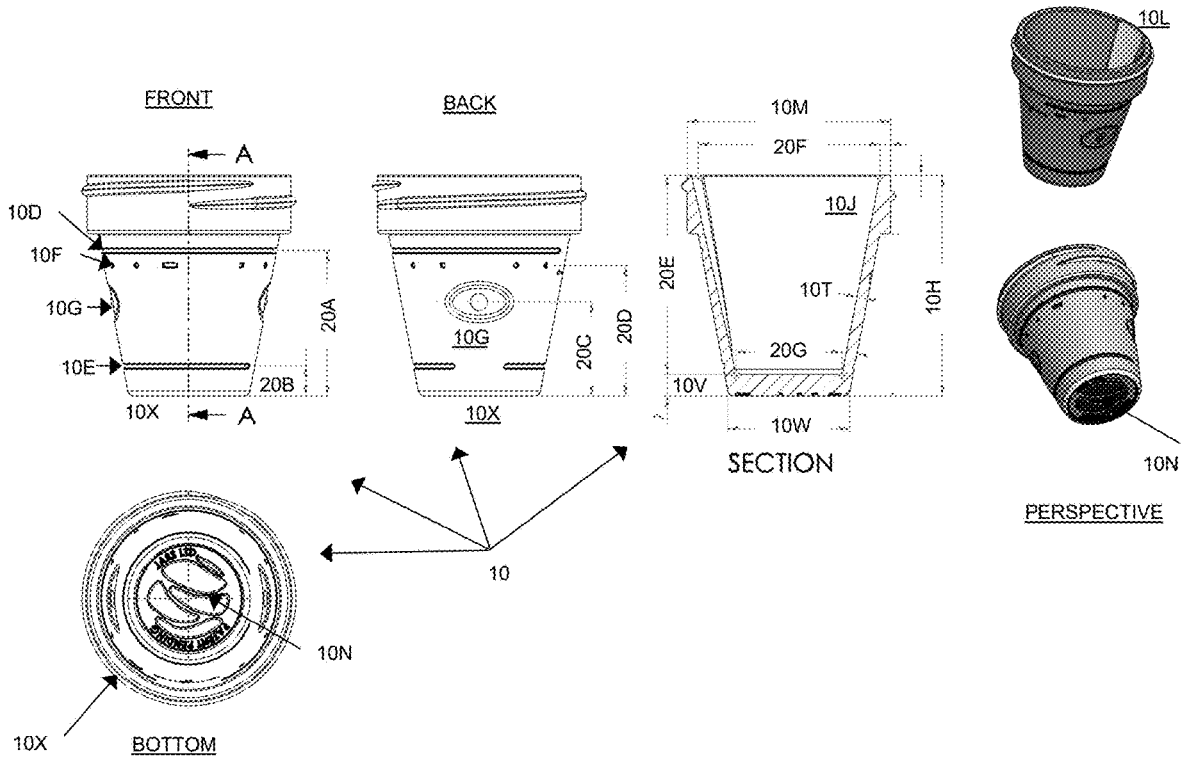

FIGS. 1-6 are schematic diagrams of various disclosed embodiments of a container 10 of the disclosed container systems introduced herein. FIGS. 1 and 2 show a first embodiment of a container 10 with a four oz exemplary volume. FIG. 1 is an illustration of the various components and features of an improved container 10 in the container system now introduced. In various embodiments, a container 10 includes a top portion 10A (sometimes also referred to herein as a mouth or a top rim edge); a continuous or intermittent circumferentially disposed engagement lip 10B to which a lid or top (not shown) having compatible grooves may be rotationally secured thereby; a rim bottom edge 10C that engages the top edge portion of a rim of a second container when stacked; a top measurement mark 10D showing the preferred maximum fill point of the container 10 for storage, a raised gap line 10E for forcing a gap when the container 10 is stacked or nested inside another container (in some embodiments, the line 10E is substantially aligned with the inner top surface 10U of the base 10X; one or more raised bumps 10F in a variety of available configurations for the purposes described herein; a finger grip 10G which can be provided in a variety of configurations and locations for helping a person securely hold the container 10 without slippage; a circumferential rim 10J disposed around the top of the container 10; a pour spout 10L as described herein above disposed near the mouth 10A on an interior of the rim 10J within the inner volume 10K of the container 10; one or more irregularly shaped raised contours and indented grooves 10N disposed on the exterior bottom surface of the base 10X of the container for providing friction when the container 10 is placed on a flat surface in order to prevent sliding; and a side wall 10S that extends along the height 10H of the container 10 from the rim 10J to the base 10X about the container's central axis (see section line A-A). In various embodiments, the inner volume 10K is bounded by an interior of the wall 10S and an inner top surface 10U of the base 10X.

FIG. 1 further includes a section view A-A along central axis A of an exemplary container 10 having an exemplary volume 10K of 4 oz. FIG. 1 further shows various exemplary measurements and angles thereof for manufacture of an improved container 10, which will be referenced herein. In this exemplary instance, such an improved container 10 has a diameter of a mouth 10M of approximately 67 mm, a diameter 10W the base 10X of approximately 40.5 mm, a height 10H of approximately 72 mm, a height of the rim 10J of approximately 19 mm, a top thickness 10P of the rim 10J of approximately 3.5 mm, wherein a wall angle 10R is 10.75 degrees from vertical (or 79.25 degrees from horizontal), a wall thickness 10T of approximately 3.5 mm, and a base height 10V of approximately 7 mm. However, a container 10 may have other useful dimensions as described herein in more detail. As one example, it is contemplated that approximately as used herein generally implies a tolerance of ten percent of the value, unless otherwise indicated.

FIG. 2 shows further exemplary measurements and dimensions of an improved container 10 having an exemplary volume of 4 oz. in certain embodiments. Other measurements and dimensions of such a container 10 include, but are not limited to: a measured height 20A from the bottom of the base 10X to the top measuring mark 10D; a measured height 20B from the bottom of the base 10X to the raised gap line 10E; a measured height 20C from the bottom of the base 10X to the center of the finger grip 10G; a measured height 20D from the bottom of the base 10X to the raised bumps 10F; a measured height 20E from the top inner surface 20U of the base 10X to the top of the container 10 (i.e., at mouth 10M); an inner diameter 20F of the mouth 10M measured from inside the wall 10S; and an inner width 20G of the inner top surface 10U of the base 10X. In a particular non-limiting example, an improved container 10 of the contemplated container system with a 4 oz storage capacity has the following measurements: measured height 20A is approximately 47 mm, measured height 20B is approximately 9.7 mm, measured height 20C is approximately 30.6 mm, measured height 20D is approximately 42.5 mm, measured height 20E is approximately 64.8 mm, inner diameter 20F is approximately 59.35 mm; and the inner width 20G is approximately 34.9 mm.

Figure 3:
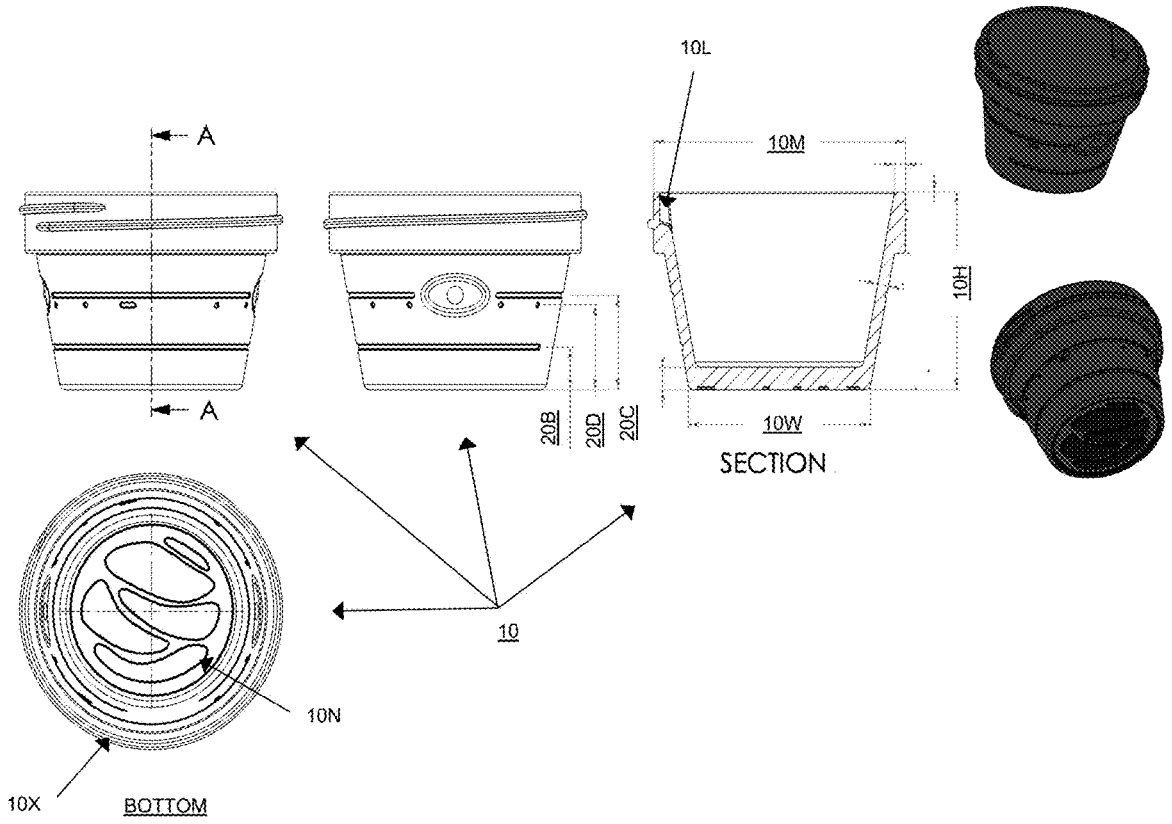
Figure 4:
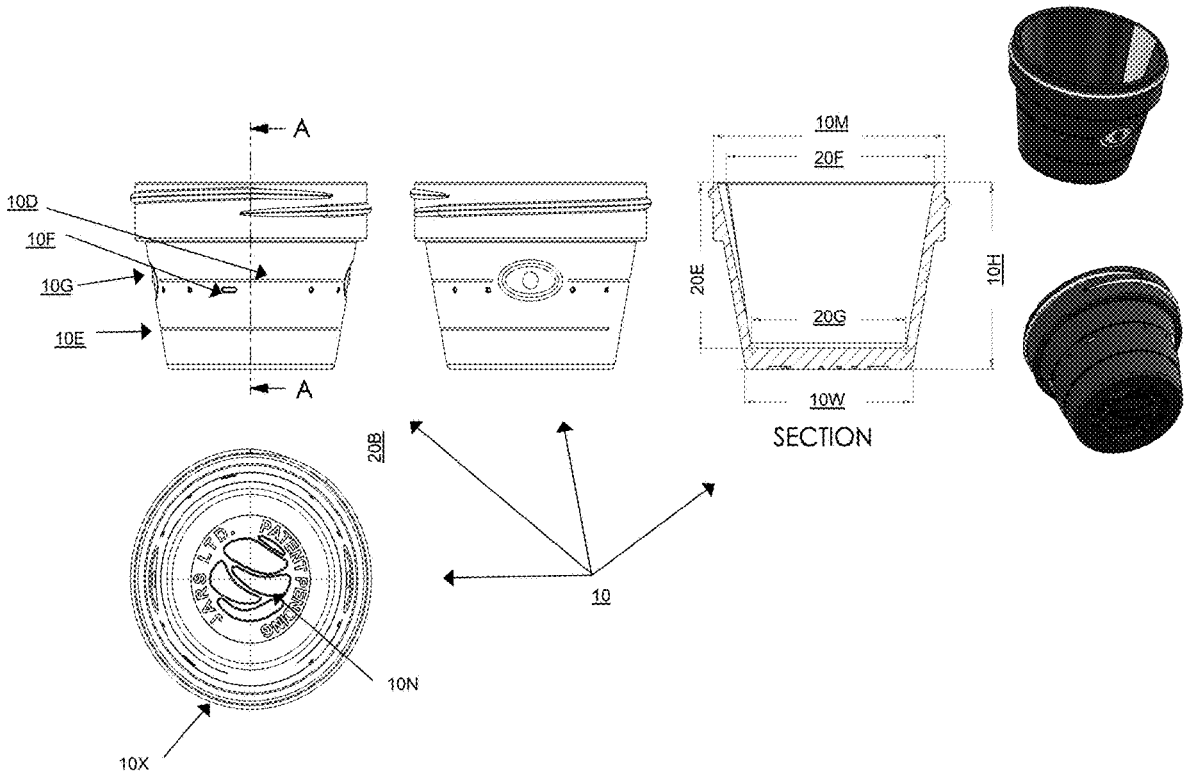

FIG. 3 and FIG. 4 show the same components, measurements, angles and dimensions as above for an exemplary container having 6 oz. of volume. FIG. 3 depicts a particular non-limiting example of an improved container 10 with a 6 oz storage capacity, which has the following measurements: the diameter of the mouth 10M is approximately 81.6 mm; the height 10H is approximately 61 mm, the diameter 10W of the base 10X is approximately 59.2 mm, measured height 20B is approximately 13.2 mm, measured height 20C is approximately 29.11 mm, measured height 20D is approximately 26.2 mm.

FIG. 4 shows further measurements of the exemplary embodiment of FIG. 3, wherein measured height 20E is approximately 64.8 mm, inner diameter 20F is approximately 73.5 mm; and the inner width 20G is approximately 54.1 mm.

Figure 5:
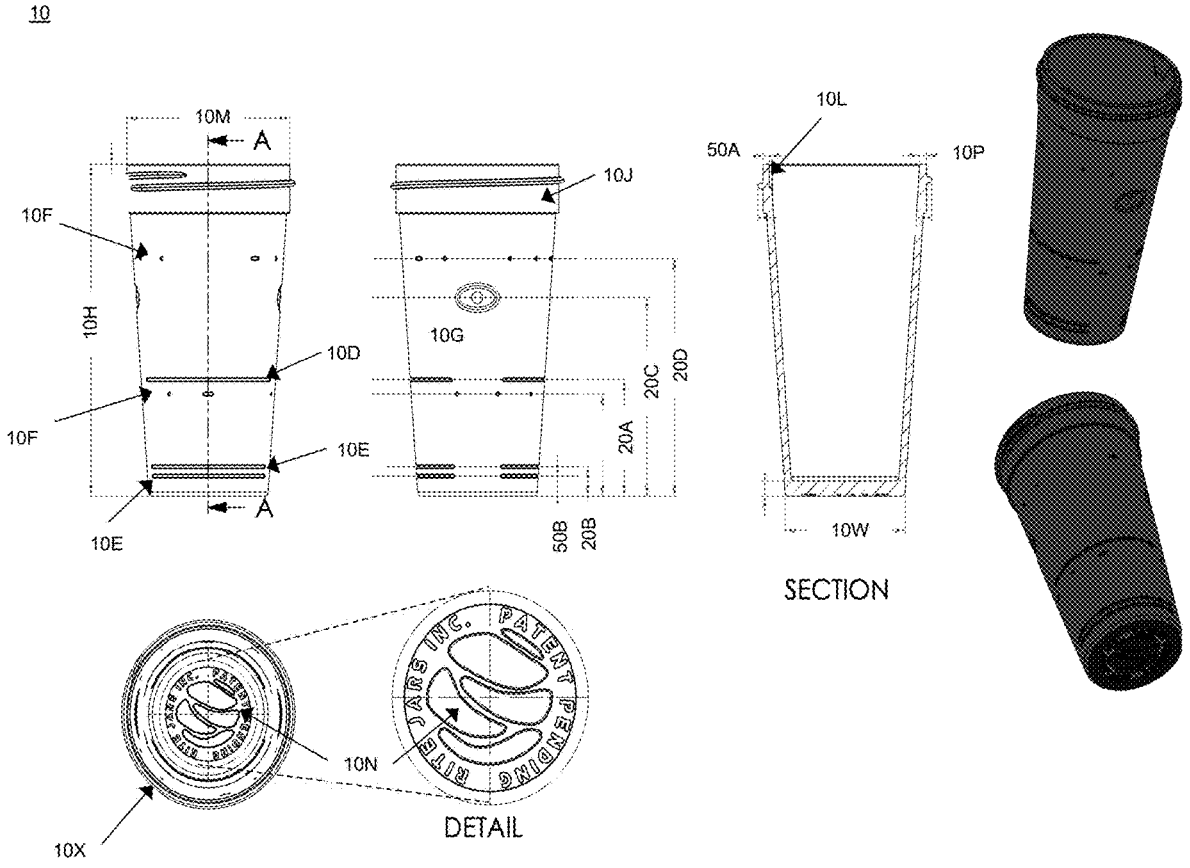
Figure 6:
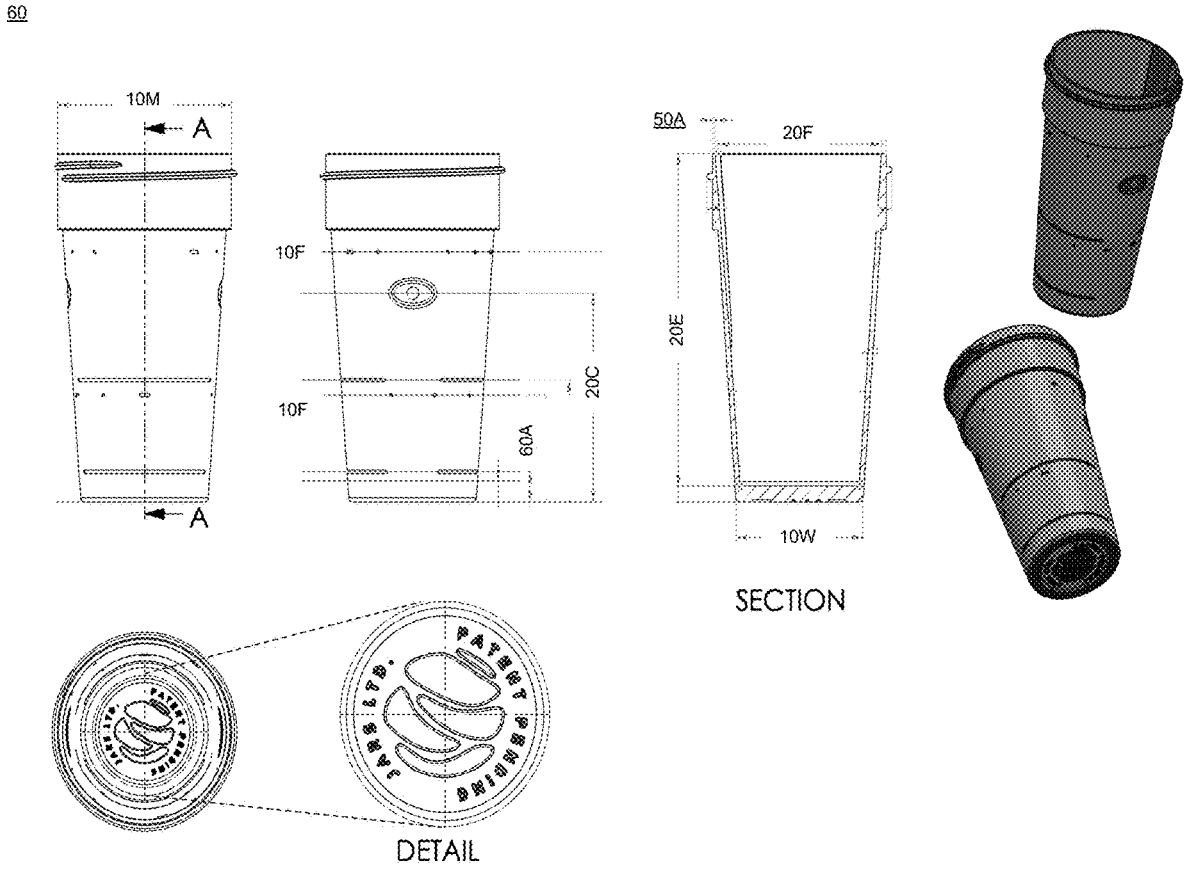

FIG. 5 and FIG. 6 show the same components, measurements, angles and dimensions as above for an exemplary container 10 having 16 oz. of volume/storage capacity. Referring to FIG. 5, one non limiting example of the container 10 having 16 oz. of storage capacity includes the following measurements: the diameter of the mouth 10M is approximately 81.6 mm; the height 10H is approximately 152 mm, the diameter 10W of the base 10X is approximately 60 mm, measured height 20A is approximately 53.3 mm, measured height 20B is approximately 13.5 mm, measured height 20C is approximately 91.2 mm, measured height 20D is approximately 109 mm, a top thickness 10P of the rim 10J is approximately 3.5 mm, and a top thickness 50A of the rim 10J at the top of the pour spout 10L is approximately 3 mm. In certain non-limiting embodiments where there are two gap lines 10E provided substantially in parallel near alignment with the inner top surface 10U of the base 10X, the distance 50B between the two gap lines 10E is approximately 9.2 mm.

Referring now to FIG. 6 and continuing with the non-limiting example of FIG. 5, the improved container 10 having 16 oz. of storage capacity additionally includes the following measurements: measured height 20E is approximately 145.1 mm, inner diameter 20F is approximately 76.97 mm, and a top thickness 50A of the rim 10J at the top of the pour spout 10L is approximately 1 mm. In this example, there may be provided two separate bands of raised bumps 10F and the height 60A from the bottom of the base 10X to the lower of the two bands of raised bumps 10F is approximately 46.8 mm.

Figure 7:
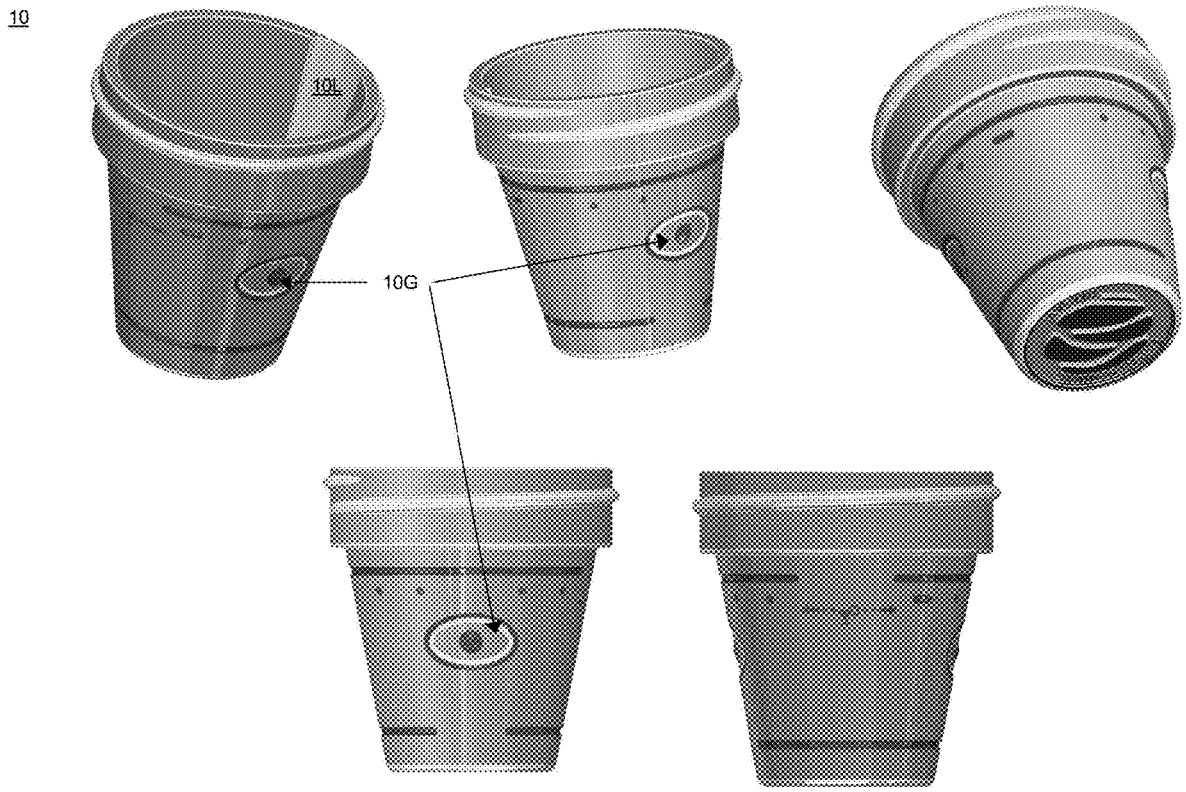
FIGS. 7-9 are illustrations of a container from various perspectives in accordance with various embodiments.

FIG. 7 includes illustrations of an improved container 10 from various perspectives and side views in accordance with various embodiments.

Figure 8:
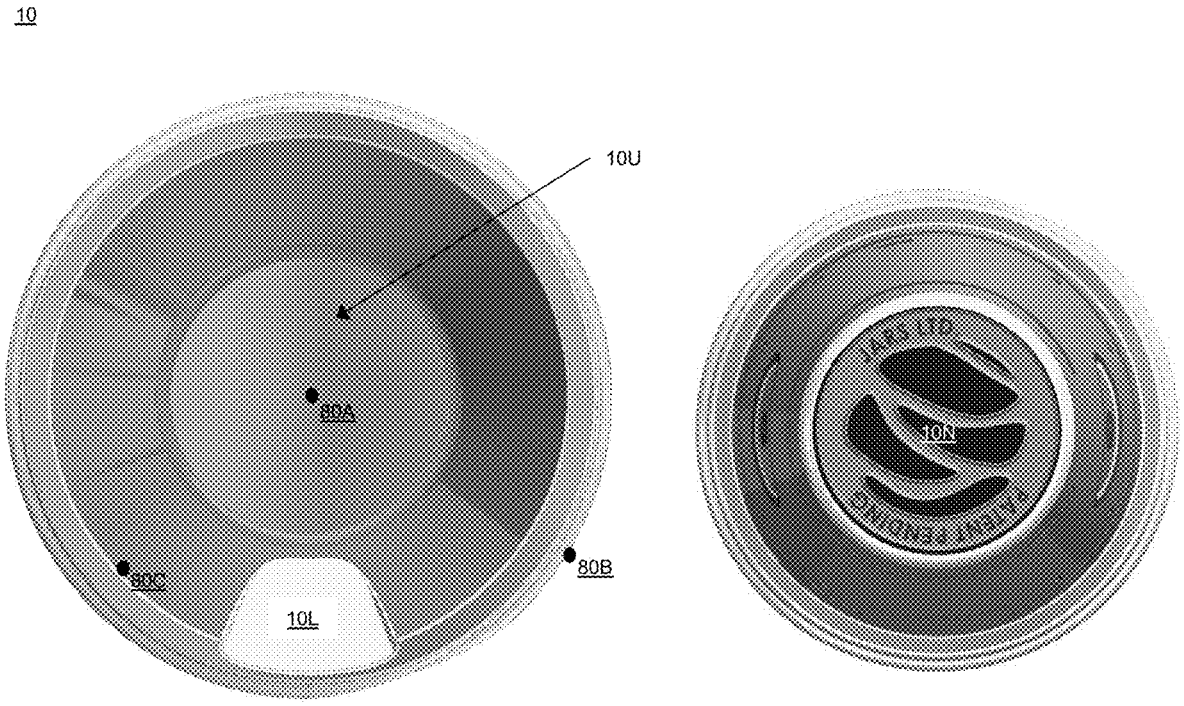

FIG. 8 includes a top view of an exemplary container 10 on the left and a bottom view of an exemplary container 10 on the right, according to various embodiments. Shown therein a virtual center point 80 A of the inner top surface 10U, a virtual point 80B disposed on the edge of the mouth of the container 10, and a virtual point 80C disposed on the edge of the mouth of the container 10. In various instances, virtual point 80B is disposed anywhere along the outer circumference of the rim of the container 10 and the mouth. In various instances, virtual point 80C is disposed anywhere along the inner circumference of the rim 10J of the container 10 at the mouth thereof.

Figure 9:
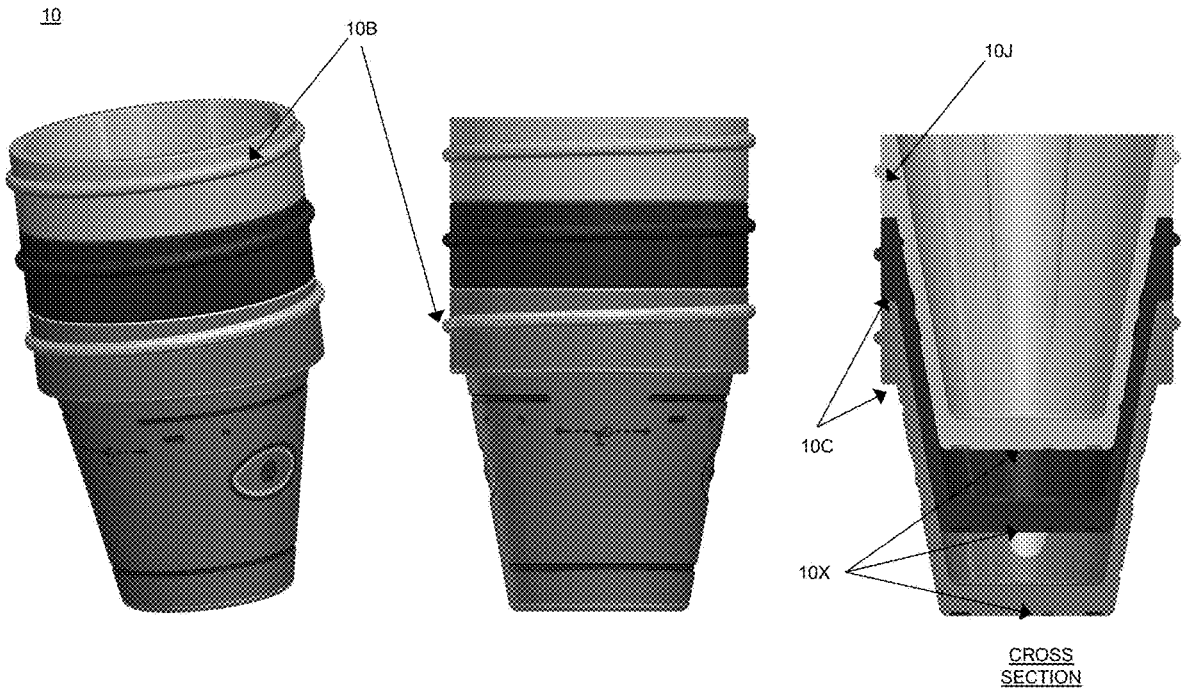

FIG. 9 shows a perspective view, a side view and a cross-section view of stacked improved containers 10. In some embodiments, the bottom of a nested or stacked container 10 reaches the inner bottom surface of the container 10 in which it is nested. In other embodiments, a nested container 10 does not extend to the inner bottom surface.

Figure 10:
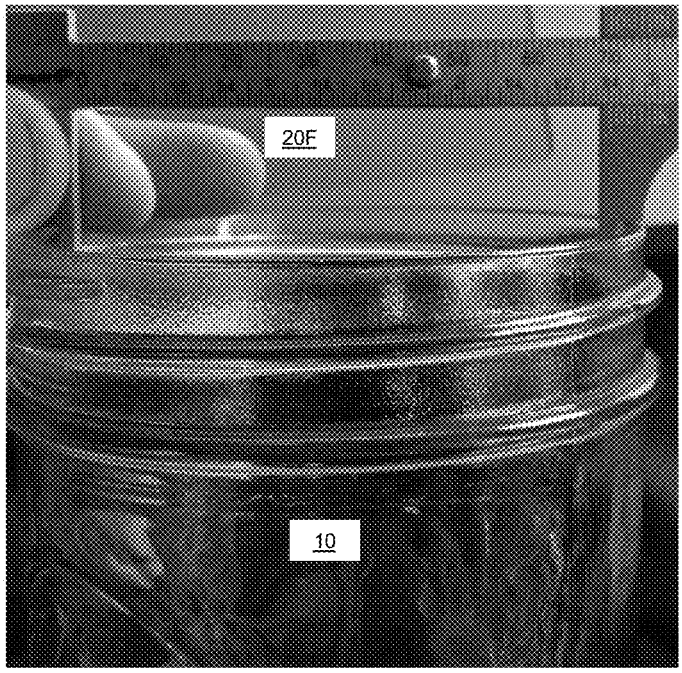
FIGS. 10-14 are depictions showing the measurements of certain elements of a container in accordance with various embodiments.
Figure 11:
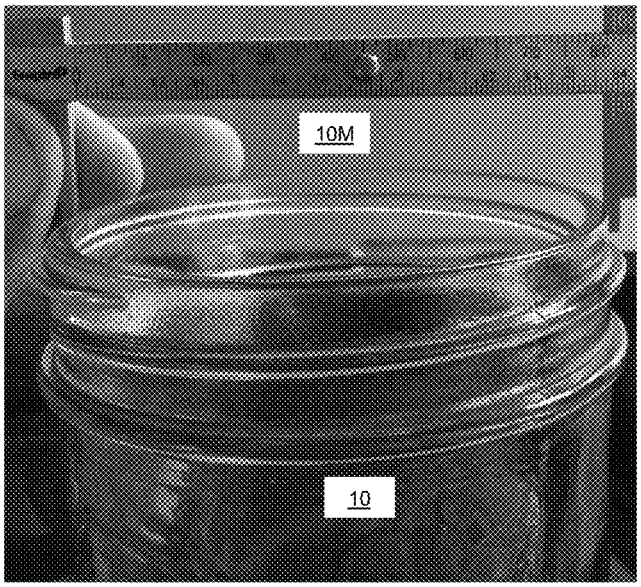
Figure 12:
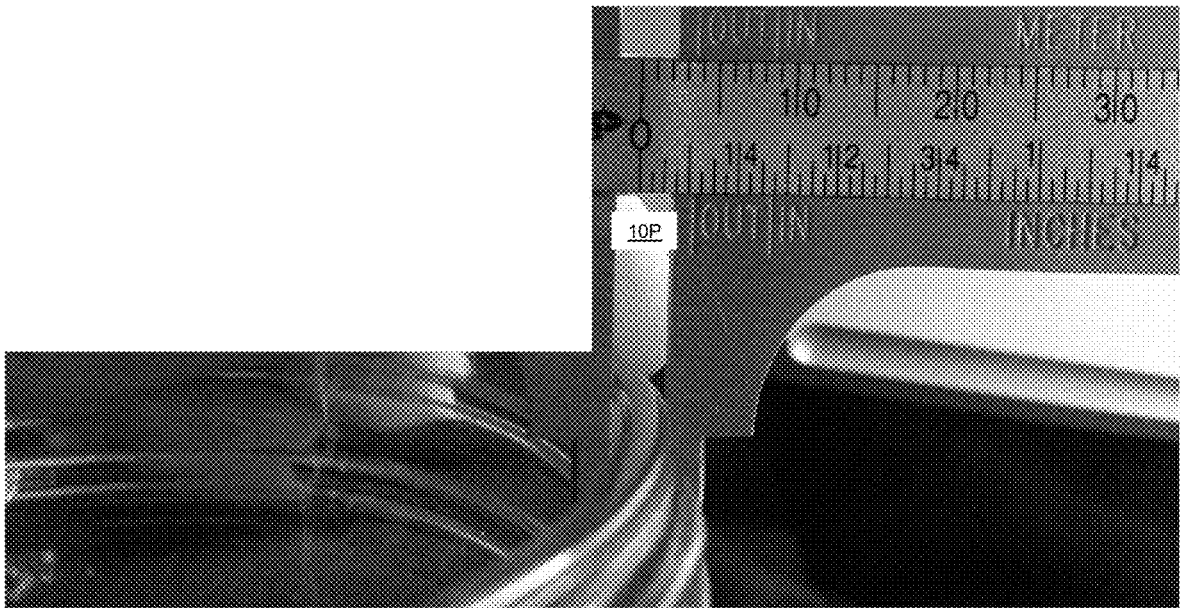
Figure 13:
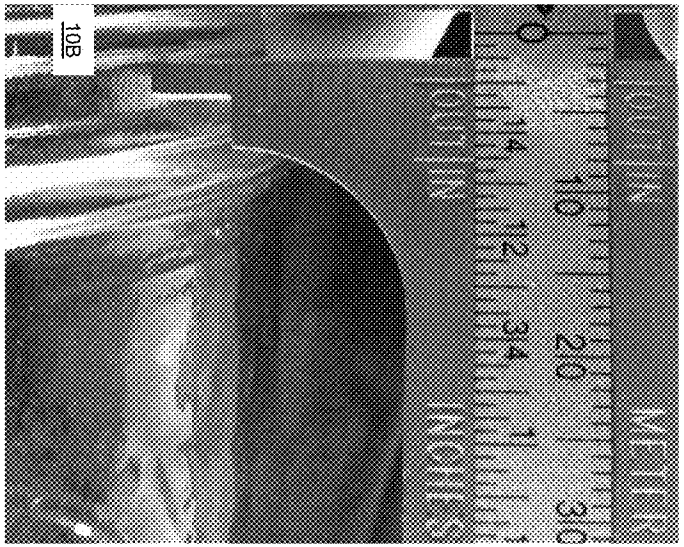
Figure 14:
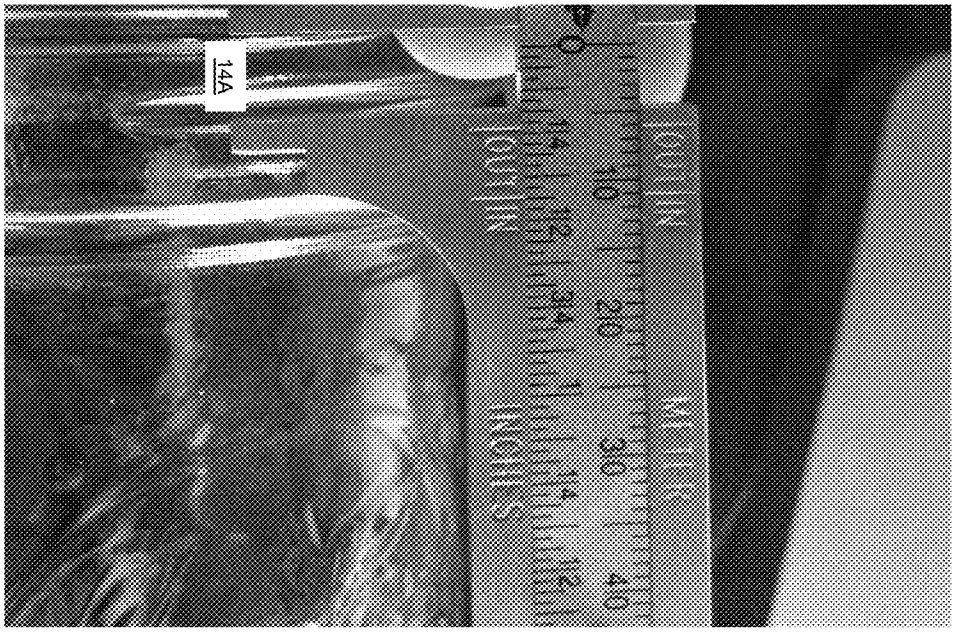
Figure 15:
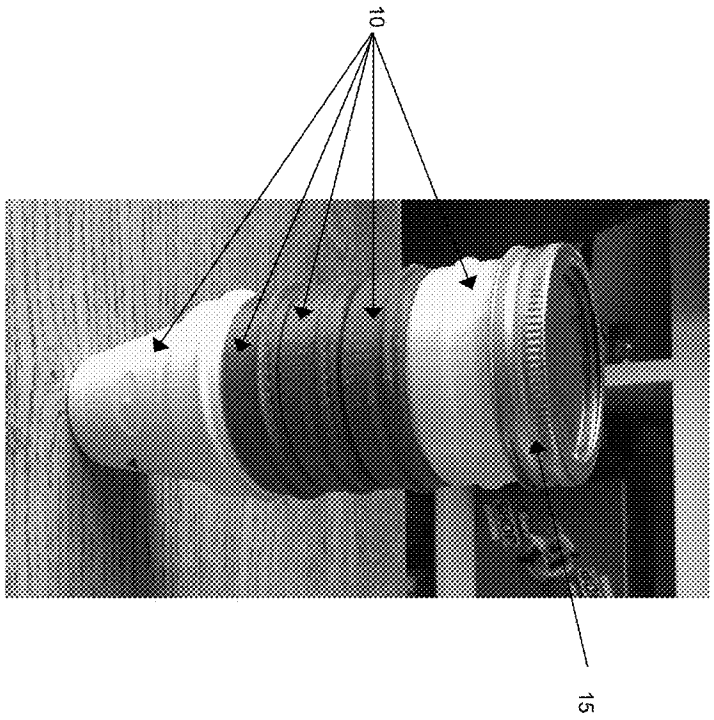
FIG. 15 is a depiction of stacked containers in accordance with various embodiments.
Figure 16:
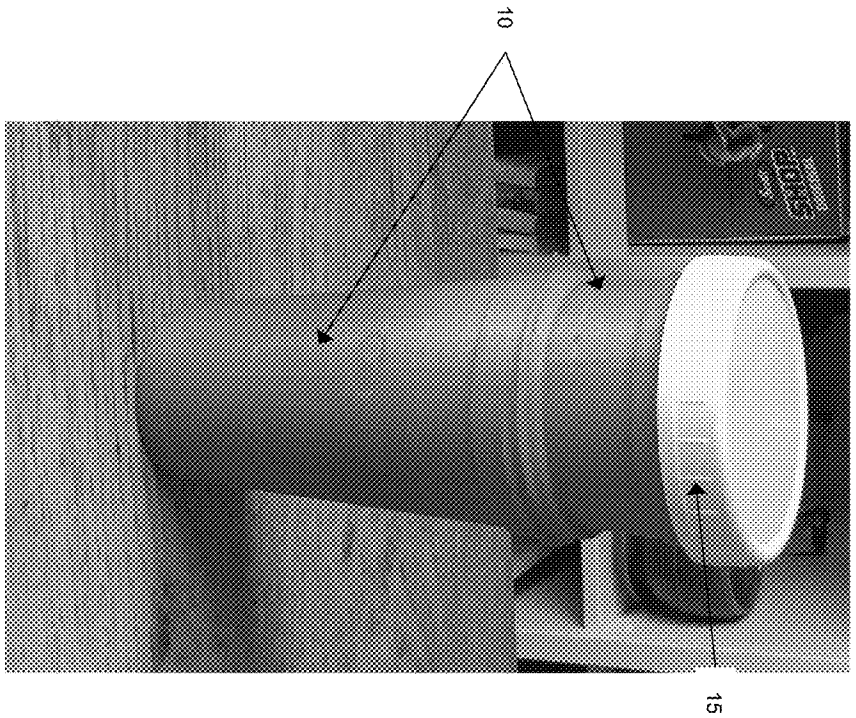
FIG. 16 is a depiction of additional stacked containers in accordance with various embodiments.
Figure 17:
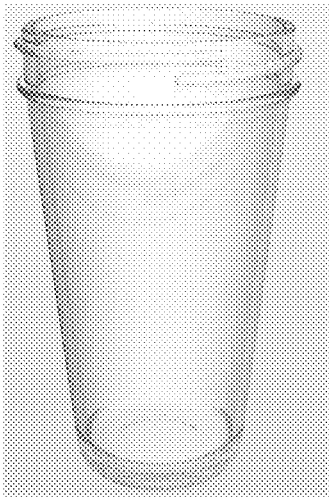
FIG. 17 is an illustration of transparent containers in accordance with various embodiments.
Figure 17:
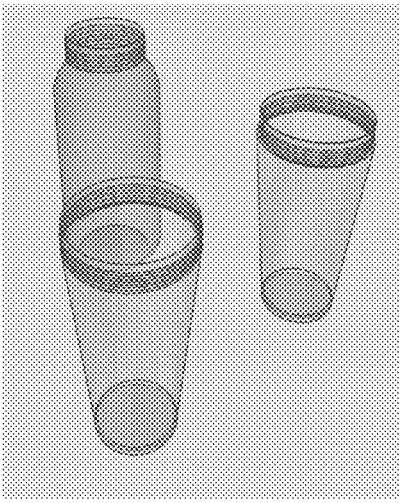

FIGS. 10, 11, 12, 13 and 14 are real-world depictions of exemplary measurements of select portions of an improved container 10 in accordance with certain embodiments. FIG. 10 shows an exemplary measurement of the inner diameter 20F of the top opening of an improved container 10 in certain embodiments. FIG. 11 shows an exemplary measurement of the outer diameter 10M of the mouth of an improved container 10 in certain embodiments. FIG. 12 shows an exemplary measurement of the top thickness 10P of the rim at the mouth of an improved container 10 in certain embodiments. FIG. 13 shows an exemplary measurement of the engagement lip 10B disposed circumferentially around the rim 10J of an improved container 10 in certain embodiments. FIG. 14 shows an exemplary measurement of the distance 14A between two portions of the engagement lip 10B around the top opening of an improved container 10. FIG. 15 is a photograph of stacked improved containers 10 in accordance with various embodiments, where the topmost container has a lid 15 rotationally secured thereto. FIG. 16 is a photograph of additional stacked improved containers 10 in accordance with various embodiments, where the topmost container has a lid 15 rotationally secured thereto. FIG. 17 is an illustration of transparent improved containers 10 in accordance with various embodiments.

A core feature of the improved containers 10 is that they readily and stably nest inside of each other when they are empty. As a result, the available ratios of height to wall angle has been determined to fall within a narrow range. A formula can be manually or programmatically used to determine appropriate sizes and dimensions of the containers disclosed herein. For a given volume, the formula then calculates the appropriate mouth (top opening) size, the base (bottom) size, the height of the container, the angle of the exterior wall extending from the bottom, and the width of the exterior wall. In various embodiments, the interior of the wall is substantially parallel to the exterior of the wall in either one or more sections or the entirety thereof.

An exemplary useful formula for determining container dimensions and volume is V=(π*H)/3 (R^2+R*r+r^2) where "V", "H", "R" and "r" are volume, container height, larger mouth radius, and smaller base radius of the conical portion of the container 10, respectively. For any given volume, there are many 'right' answers, meaning that many different shapes will still result in jars that nest nicely inside of each other. However, wider bases are preferred as the first consideration so as to provide superior upright stability.

Canning jars, in particular, have fixed mouth sizes because they traditionally use the same lids. Typically, the outside diameter of the mouth size is either 81.6 millimeters (mm) for a "large mouth" jar, or 66.5 mm for a 'small mouth jar.' Because the container walls, in such embodiments, need to be about 3 mm thick in order to withstand the heat and pressure of canning, one subtracts 2 mm×3 mm=6 mm from the outside diameter to get the inside diameter. So, for an exemplary 'large-mouth' jar, a larger base radius ("R") would be 81.6 mm-6 mm=75.6 mm.

In cases where it is undesirable for the liquid to go all the way to the top of the jar, it is necessary to leave a gap at the top of the container. When a preferred wall angle is known, one can employ an easy triangle calculation to figure out the diameter a certain percentage of the way down from the top of the container. In other instances, the wall angle 10R is variable and ranges between 4.01° and 10.75°. In many instances, 7° is a reasonable and useful baseline to use for the wall angle.

For the base, the outside diameter needs to be smaller than the inside diameter of the mouth for nesting, in various embodiments, and the nested container needs to be about the same size as the inside of the receiving container about two-thirds of the way down or within a reasonable and useful range thereof. The rim bottom 10C of a stacked container 10 rests on the top of the container 10 in which it is nested. In various embodiments, the diameter of the base must be less than the mouth width minus two times the wall thickness.

In various embodiments, the width of the wall may be constant and ranges between 2.3 mm and 4 mm are useful. In various embodiments, the interior/exterior wall angles between 4.062° and about 12° are useful.

While many containers can nest to some degree, not all combinations of wall angles, container heights and wall angles will nest 'well'. If the wall thickness compared to the wall angle is too thick, the containers won't nest deeply. If the wall angle is too steep, the container will be inclined to tip. One of the key features of these storage containers is that the wall-angle, jar height, and wall thickness of the jars can be described by a range of ratios between two triangles, as described by the following:

Triangle 1 (Outer triangle):

Point A: Point at top outer edge of the container. (see, e.g., point 80B of FIG. 8).

Point B: The center of the base of the container. (see, e.g., point 80 A of FIG. 8)

Point C: The point that is at base level and vertically directly below point A.

Triangle 2 (Inner triangle):

Point D: Point at inner edge of the wall at the mouth of the container. (see, e.g., point 80C of FIG. 8)

Point B: The center of the base of the container (same as above).

Point F: Point directly below point D at base level.

Given:

Angle ∠BAC=θ, where 6.5°≤θ≤10.5°

Angle ∠ACB=∠DFB=90°

Wall thickness t, where 0.5 mm≤t≤3.5 mm h as the height of the container.

Outer diameter of the mouth of the container, $D_{outer}$

Smaller mouthed container: ~66.8 mm

Larger mouthed container: ~81.6 mm

Area Calculation of Triangles:

1. Outer Triangle Area (A1):

$$A1 = \frac{1}{2} \times \text{Base} \times \text{Height} = \frac{1}{2} \times (h \times \tan(\theta)) \times h = \frac{1}{2} \times \tan(\theta) h^2 = \frac{\tan(\theta) h^2}{2}$$

2. Inner Triangle Area (A2):

$$A2 = \frac{1}{2} \times \text{Base} \times \text{Height} = \frac{1}{2} \times \left(\text{Base}_{outer} - \frac{t}{\cos\theta}\right) \times h = \frac{\left((h \times \tan(\theta)) - \frac{t}{\cos\theta}\right) \times h}{2}$$

A Summary of the Formula:

The ratio R between the two triangles is:

$$R = \frac{A2}{A1} = \frac{\frac{\left(\text{Base}_{outer} - \frac{t}{\cos\theta}\right) \times h}{2}}{\frac{\tan(\theta) h^2}{2}} = \frac{\left(\text{Base}_{outer} - \frac{t}{\cos\theta}\right) \times h}{\tan(\theta) h^2} = \frac{(h \times \tan(\theta)) - \frac{t}{\cos\theta}}{\tan\theta \cdot h}$$

The ratio moves towards 1 as the wall thickness (t) moves towards 0, and the ratio moves towards 0 as the height (h) moves towards 0.

With the above formulas, the ideal ratios for the smaller and larger mouthed container are:

Small-mouthed container: 0.601≤R≤0.839

Large-mouthed container: 0.62≤R≤0.81

Another related ratio that defines these containers is the wall angle compared to cosine of the wall thickness.

Where:

Wall Angle=θ

Wall thickness=t

One can calculate the thickness t of the container at the mouth with the following:

$$t_{mouth} = \frac{t}{\cos\theta}$$

For an ideal 'nesting', the ratio between $t_{mouth}$ and θ is $$0.18 < r < 0.78$$

By way of comparison, a typical SOLO cup has a ratio of about 0.04

FIG. 18 depicts exemplary code for instructing a computer to generate and determine suitable dimensions of an improved container 10 according to the principals introduced in the foregoing.

In accordance with the improvements disclosed in the foregoing, an improved container 10 with a height (H), includes, in various embodiments, a substantially circular mouth having a rim 10M with a first radius (R), the rim 10M having a top edge and a bottom edge 10C, where the bottom edge 10C is provided to engage a second top edge of a second rim of a second container when the container and the second container are stacked. In such embodiments, the container 10 further includes a substantially circular base having a center and a second diameter (r) extending to an outer circumference, where the second radius is smaller than the first radius, and a wall having a thickness (t), the wall 10S continuously extending from the rim of the mouth to the outer circumference around a central axis defining the height of the container 10. In such embodiments, the wall is tapered to facilitate nesting and has a non-uniform circumference along an entire length of the central axis such that the wall forms a section of a cone, where an internal volume (V) of the container substantially satisfies the formula: V=(πH/3)(R^2+R*r+r^2).

In additional embodiments, a container 10 has a ratio of (i) a first area of a first right triangle having a first hypotenuse extending from the center 80A of the base to a point 80 B on an exterior edge of the rim of the container 10, to (ii) a second area of a second triangle having a second hypotenuse extending from the center 80A of the base to a point 80C on an interior edge of the rim is substantially between 0.601 and 0.839. In such embodiments, a ratio of the first area to the second area is substantially between 0.62 and 0.81. In additional embodiments, the wall 10S extends from the base 10X at an angle (θ) substantially between 4.01° and 12° from vertical. In additional embodiments, the thickness (t) of the wall 10S is substantially between 0.5 millimeters (mm) and 4 mm and a thickness of the container 10 at the mouth ($t_{mouth}$) is substantially equal to t/cos(θ). In additional embodiments, a ratio of $t_{mouth}$ to θ is substantially between 0.18 and 0.78. In additional embodiments, an outside diameter of the mouth size is substantially between 66.5 millimeters (mm) and 81.6 millimeters (mm). in additional embodiments, a diameter of the base is less than a diameter of the mouth minus two times the thickness (t) of the wall. In additional embodiments, the thickness (t) of the wall 10S is substantially constant between the mouth 10M or the rim 10J and the base 10X. In additional embodiments, the outside diameter of the base is smaller than an inside diameter of the mouth 10M in order to accommodate nesting with the second container. In additional embodiments, a pour spout 10L is disposed on an inner portion of the wall 10S at a top portion of the container 10. In additional embodiments, the pour spout 10L functions as an air gap to prevent the container 10 and the second container from adhering together when nested due to moisture cohesion or suction. In additional embodiments, a bottom or base 10X of the container 10 reaches a bottom of the second container when stacked. In alternate embodiments, a bottom of the container 10 does not reach a bottom or base of the second container when stacked. In additional embodiments, an exterior of the wall 10S includes at least one finger grip 10G. In additional embodiments, an exterior or interior of the wall 10S includes at least one measuring mark delineating at least one of an English and a metric volume measurement. In additional embodiments, the measurement mark comprises at least one of a raised tic mark and an indented tic mark. In additional embodiments, the measurement mark is configured as at least one of a dash and a dot. In additional embodiments, a volume of the container 10 is the same as a volume of the second container with which it is nested or stacked. In additional embodiments, a volume of the container is different than a volume of the second container with which it is stacked or nested.

Although the best methodologies have been particularly described in the foregoing disclosure, it is to be understood that such descriptions have been provided for purposes of illustration only, and that other variations both in form and in detail can be made thereupon by those skilled in the art without departing from the spirit and scope thereof.

What is claimed is:

1. A container having a height (H), the container comprising:

a substantially circular mouth having a rim and a first radius (R), the rim having a top edge and a bottom edge, where the bottom edge is provided to engage a second top edge of a second rim of a second container when the container and the second container are stacked;

a substantially circular base having a center and a second radius (r) extending to an outer circumference, where the second radius is smaller than the first radius; and a wall having a thickness (t), the wall continuously extending from the rim of the mouth to the outer circumference around a central axis defining the height of the container, where the wall is tapered to facilitate nesting and has a non-uniform circumference along an entire length of the central axis such that the wall forms a section of a cone, where an internal volume (V) of the container substantially satisfies the formula:

$$V = (\pi * H)/3(R^\wedge 2 + R * r + r^\wedge 2).$$

2. The container of claim 1, where a ratio of a first area of a first right triangle having a first hypotenuse extending from the center of the base to an exterior edge of the rim, to a second area of a second triangle having a second hypotenuse extending from the center of the base to an interior edge of the rim is substantially between 0.601 and 0.839.

3. The container of claim 2, where the ratio of the first area to the second area is substantially between 0.62 and 0.81.

4. The container of claim 1, where the wall extends from the base at an angle (θ) substantially between 4.01° and 12° from vertical.

5. The container of claim 4, where the thickness (t) of the wall is substantially between 0.5 millimeters (mm) and 4 mm; and a thickness of the container at the mouth ($t_{mouth}$) is substantially equal to t/cos(θ).

6. The container of claim 5, where a ratio of $t_{mouth}$ to θ is substantially between 0.18 and 0.78.

7. The container of claim 1, where an outside diameter of the mouth size is substantially between 66.5 millimeters (mm) and 81.6 millimeters (mm).

8. The container of claim 1, where a diameter of the base is less than a diameter of the mouth minus two times the thickness (t) of the wall.

9. The container of claim 1, where the thickness (t) of the wall is substantially constant between the rim and the base.

10. The container of claim 1, where the outside diameter of the base is smaller than an inside diameter of the mouth in order to accommodate nesting with the second container.

11. The container of claim 1 further comprising:

a pour spout disposed on an inner portion of the wall at a top portion of the container.

12. The container of claim 11, where the pour spout functions as an air gap to prevent the container and the second container from adhering together when nested due to moisture cohesion or suction.

13. The container of claim 1, where a bottom of the container reaches a bottom of the second container when stacked.

14. The container of claim 1, where a bottom of the container does not reach a bottom of the second container when stacked.

15. The container of claim 1, where an exterior of the wall includes at least one finger grip.

16. The container of claim 1, where an exterior of the wall includes at least one measuring mark delineating at least one of an English and a metric volume measurement.

17. The container of claim 16, where the measurement mark comprises at least one of a raised tic mark and an indented tic mark.

18. The container of claim 17, where the measurement mark is configured as at least one of a dash and a dot.

19. The container of claim 1, wherein a volume of the container is the same as a volume of the second container.

20. The container of claim 1, wherein a volume of the container is different than a volume of the second container.

* * * * *